US009480874B2

(12) United States Patent
Cutler

(10) Patent No.: US 9,480,874 B2
(45) Date of Patent: Nov. 1, 2016

(54) LOCKING MECHANISM FOR A VERTICALLY STORABLE EXERCISE MACHINE

(71) Applicant: ICON Health & Fitness, Inc., Logan, UT (US)

(72) Inventor: Gordon Cutler, Providence, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 15 days.

(21) Appl. No.: 14/575,763

(22) Filed: Dec. 18, 2014

(65) Prior Publication Data

US 2015/0182782 A1 Jul. 2, 2015

Related U.S. Application Data

(60) Provisional application No. 61/922,685, filed on Dec. 31, 2013.

(51) Int. Cl.

| | |
|---|---|
| ***A63B 22/02*** | (2006.01) |
| ***A63B 22/00*** | (2006.01) |
| *A63B 69/00* | (2006.01) |
| *A63B 71/06* | (2006.01) |

(52) U.S. Cl.

CPC ..... *A63B 22/0046* (2013.01); *A63B 22/02* (2013.01); *A63B 69/0057* (2013.01); *A63B 2071/0658* (2013.01); *A63B 2210/50* (2013.01); *Y10T 403/32262* (2015.01)

(58) Field of Classification Search

USPC ..... 482/1–148

See application file for complete search history.

(56) References Cited

U.S. PATENT DOCUMENTS

| | | | | |
|---|---|---|---|---|
| 5,344,372 | A | 9/1994 | Hung | |
| 6,010,432 | A * | 1/2000 | Vawter | A61H 15/00 482/54 |
| 6,059,695 | A | 5/2000 | Hung | |
| 6,077,200 | A * | 6/2000 | Lin | A63B 22/02 482/51 |
| 6,123,649 | A * | 9/2000 | Lee | A63B 21/153 482/51 |
| 6,913,562 | B2 * | 7/2005 | Chen | A63B 22/02 482/54 |
| 6,979,283 | B2 * | 12/2005 | Pan | A63B 22/02 482/54 |
| 7,004,887 | B2 * | 2/2006 | Pan | A63B 22/02 482/54 |
| 7,291,096 | B2 | 11/2007 | Ho | |
| 7,540,829 | B1 | 6/2009 | Chen | |
| 7,695,409 | B2 * | 4/2010 | Helie | A63B 22/02 482/148 |

(Continued)

*Primary Examiner* — Stephen Crow

(74) *Attorney, Agent, or Firm* — Holland & Hart LLP

(57) ABSTRACT

An exercise machine includes a frame, at least one arm rest connected to a first portion of the frame, and an exercise platform connected to a second portion of the frame. The at least one arm rest pivotally connected to the first portion to be oriented between an arm rest storage position and an arm rest operating position. The exercise platform is pivotally connected to the second portion to allow the platform to be oriented between a platform storage position and a platform operating position. A locking mechanism to connect the exercise platform to the frame in the platform storage position.

18 Claims, 10 Drawing Sheets

(56) References Cited

U.S. PATENT DOCUMENTS 7,780,578 B2 * 8/2010 Packham ..... A63B 22/02 482/4
7,862,483 B2 * 1/2011 Hendrickson ..... A63B 21/0051 482/52
7,892,149 B2 * 2/2011 Wu ..... A63B 22/0235 482/54
7,942,788 B2 * 5/2011 Wu ..... A63B 22/0235 482/51
8,182,399 B2 * 5/2012 Davis ..... A63B 22/02 482/54
8,241,187 B2 * 8/2012 Moon ..... A63B 22/0002 482/1
8,734,302 B2 * 5/2014 Hsieh ..... A63B 22/02 482/54
8,801,581 B2 * 8/2014 Lai ..... A63B 22/02 482/142
8,920,291 B2 * 12/2014 Chen ..... A63B 22/0235 482/54
8,926,479 B2 * 1/2015 Chen ..... A63B 22/02 292/137
2004/0043873 A1 * 3/2004 Wilkinson ..... A63B 22/0005 482/54
2005/0148440 A1 * 7/2005 Denton ..... A63B 71/0622 482/54
2007/0066448 A1 3/2007 Pan et al.
2007/0123396 A1 * 5/2007 Ellis ..... A63B 21/0618 482/54
2008/0280734 A1 * 11/2008 Dickie ..... A63B 22/0023 482/54
2009/0181830 A1 * 7/2009 Wu ..... A63B 22/001 482/54
2011/0281691 A1 * 11/2011 Ellis ..... A63B 22/0012 482/54
2013/0203561 A1 * 8/2013 Lee ..... A63B 22/0235 482/54
2013/0237383 A1 * 9/2013 Chen ..... A63B 22/02 482/54
2014/0073488 A1 * 3/2014 Wu ..... A63B 22/02 482/54
2014/0080678 A1 * 3/2014 Wu ..... A63B 22/02 482/54
2015/0051051 A1 * 2/2015 Liu ..... A63B 22/02 482/54
2015/0202487 A1 * 7/2015 Wu ..... A63B 22/02 482/54
2015/0209610 A1 * 7/2015 Dalebout ..... A63B 22/02 482/54
2015/0250304 A1 * 9/2015 Dalebout ..... A63B 22/02 482/54
2015/0251048 A1 * 9/2015 Dalebout ..... A63B 22/0235 482/54
2015/0352396 A1 * 12/2015 Dalebout ..... A63B 22/02 482/54
2016/0008650 A1 * 1/2016 Jue ..... A63B 22/02 482/54
2016/0038785 A1 * 2/2016 Netter ..... A63B 22/0235 482/4
2016/0074701 A1 * 3/2016 Wiener ..... A63B 22/02 482/54

* cited by examiner

LOCKING MECHANISM FOR A VERTICALLY STORABLE EXERCISE MACHINE

RELATED APPLICATIONS

This application claims priority to provisional Patent Application No. 61/922,685 titled "A Locking Mechanism for a Vertically Storable Exercise Machine" filed Dec. 31, 2013. This application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, cycling, among others. In contrast, anaerobic exercise often involves high intensity exercises over a short duration of time. Popular forms of anaerobic exercise include strength training and short distance running.

Many choose to perform aerobic exercises indoors, such as in a gym or their home. Often, a user will use an aerobic exercise machine to have an aerobic workout indoors. One such type of aerobic exercise machine is a treadmill, which is a machine that has a running deck attached to a frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical machines, rowing machines, stepper machines, and stationary bikes to name a few.

One type of treadmill is disclosed in U.S. Pat. No. 7,291,096 issued to Helen Ho. In this reference, an amphibious foldable treadmill includes a main frame having at least a wheel rotatably mounted on a base of the main frame to be rolled on a ground floor, a tread belt device pivotally secured to the main frame and unfolded from the main frame to be laid on the floor for treading operation, and a hand rail device pivotally secured to the main frame and pivotally connected with the tread belt device. Upon folding of the hand rail device and the tread belt device to the main frame, the treadmill can be folded for convenient handling, moving, and launching. Other types of treadmills are described in U.S. Pat. No. 7,942,788 issued to Shen-Yi Wu and U.S. Pat. No. 7,540,829 issued to Ming Nan Chen. All of these references are herein incorporated by reference for all that they disclose.

SUMMARY

In one aspect of the invention, an exercise machine includes a frame.

In one aspect of the invention, the exercise machine includes at least one arm rest connected to a first portion of the frame.

In one aspect of the invention, the exercise machine may further include an exercise platform connected to a second portion of the frame.

In one aspect of the invention, the at least one arm rest is pivotally connected to the first portion to allow the at least one arm rest to be oriented between an arm rest storage position and an arm rest operating positions.

In one aspect of the invention, the exercise platform pivotally is connected to the second portion to allow the platform to be oriented between a platform storage position and a platform operating position.

In one aspect of the invention, the exercise machine includes a locking mechanism to connect the exercise platform to the frame in the platform storage position.

In one aspect of the invention, the exercise machine may further include a control module connected to the first portion of the frame, wherein the control module has a pivot connection that allows the control module to move between an operating position and a storage position.

In one aspect of the invention, the control module is oriented to rotate towards the at least one arm rest into a module storage position.

In one aspect of the invention, the locking mechanism comprises a single latch member.

In one aspect of the invention, the single latch member protrudes into a space between a first post of the frame and a second post of the frame.

In one aspect of the invention, the single latch member comprises a slideable surface that is shaped to accommodate moving contact with the exercise platform.

In one aspect of the invention, the single latch member is shaped to interlock with and lock the at least one arm rest into an arm rest storage position.

In one aspect of the invention, the single latch member is shaped to lock the at least one arm rest into an operating arm rest position.

In one aspect of the invention, the locking mechanism is positioned to hook a lip formed in a side of the exercise platform when the exercise platform is in a platform operating position.

In one aspect of the invention, the at least one arm rest comprises a U-shaped body positioned to form a first hand grip on a first end of the U-shaped body and a second hand grip on a second end of the U-shaped body.

In one aspect of the invention, the exercise machine may further include that a module pivot joint is connected to the U-shaped body.

In one aspect of the invention, the control module is oriented to fold into the U-shaped body about the module pivot joint.

In one aspect of the invention, the locking mechanism is spring loaded.

In one aspect of the invention, the exercise machine may further include a frame.

In one aspect of the invention, the exercise machine includes at least one arm rest and a control module connected to a first portion of the frame.

In one aspect of the invention, the exercise machine may further include an exercise platform connected to a second portion of the frame.

In one aspect of the invention, the at least one arm rest comprises arm rest pivot joints that allow the at least one arm rest to be oriented between an arm rest storage position and an arm rest operating positions.

In one aspect of the invention, the control module comprises module pivot joints that allow the control module to be oriented between a module storage position and a module operating position.

In one aspect of the invention, the exercise platform comprises platform pivot joints that allow the platform to be oriented between platform a storage position and a platform operating position.

In one aspect of the invention, the exercise machine may further include a latch member latchable to hold the at least one arm rest and the exercise platform in the storage positions by locking the first portion of the frame to the exercise platform.

In one aspect of the invention, the exercise machine may further include that the latch member is shaped to interlock with and to lock the at least one arm rest into an arm rest storage position.

In one aspect of the invention, the exercise machine may further include that the latch member is shaped to lock the at least one arm rest into an operating arm rest position.

In one aspect of the invention, the latch member comprise a slideable surface that is shaped to accommodate moving contact with the exercise platform.

In one aspect of the invention, the latch member protrudes into a space between a first post of the frame and a second post of the frame.

In one aspect of the invention the latch member is spring loaded.

In one aspect of the invention, the at least one arm rest comprises a U-shaped body positioned to form a first hand grip on a first end of the U-shaped body and a second hand grip on a second end of the U-shaped body.

In one aspect of the invention, the exercise machine may further include a frame;

In one aspect of the invention, the exercise machine includes at least one arm rest and a control module connected to a first portion of the frame.

In one aspect of the invention, the exercise machine may further include that the at least one arm rest comprises a U-shaped body positioned to form a hand grip on a first end of the U-shaped body and a second end of the U-shaped body.

In one aspect of the invention, the exercise machine may further include an exercise platform connected to a second portion of the frame.

In one aspect of the invention, the at least one arm rest comprises arm rest pivot joints that allow the at least one arm rest to be oriented between an arm rest storage position and an arm rest operating positions.

In one aspect of the invention, the control module comprises module pivot joints that allow the control module to be oriented between a module storage position and a module operating position.

In one aspect of the invention, the exercise platform comprises platform pivot joints that allow the platform to be oriented between platform a storage position and a platform operating position.

In one aspect of the invention, the exercise machine may further include a single spring loaded latch member latchable to hold the at least one arm rest and the exercise platform in the storage positions by locking the first portion of the frame to the exercise platform.

In one aspect of the invention, the single latch member protrudes into a space between a first post of the frame and a second post of the frame.

In one aspect of the invention, the single latch member is shaped to interlock with and to lock the at least one arm rest into an arm rest storage position.

In one aspect of the invention, the single latch member is shaped to lock the at least one arm rest into an operating arm rest position.

In one aspect of the invention, the latch member comprises a slideable surface that is shaped to accommodate moving contact with the exercise platform.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Figure 1:
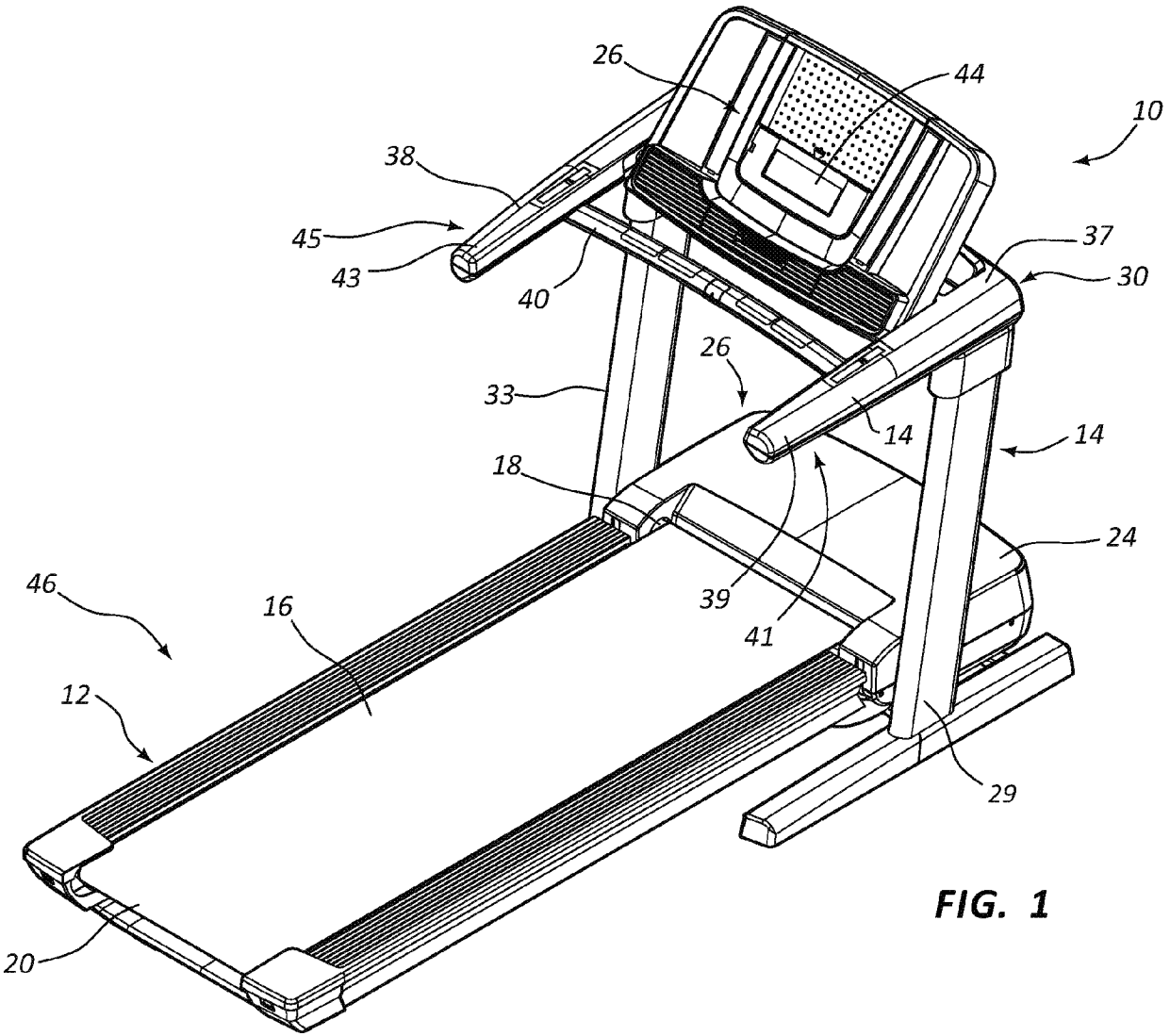
FIG. 1 illustrates a perspective view of an example of an exercise machine in accordance with the present disclosure.

Exercise machines, such as treadmills, take up space when they are not used. To minimize the space occupied by such exercise machines during periods of non-use, the running deck and frame are often configured to fold into one another such that the running deck is in a storage position. However, folding the frame down into the running deck still results in the folded treadmill occupying a significant amount of floor space. To compensate, the folded treadmill or other type of exercise machine is often lifted upright so that the running deck or other type of exercise platform stands vertically in a storage position.

A locking mechanism is incorporated into the frame of the exercise machine to prevent the running deck or other type of exercise platform from slipping out of the storage position. The locking mechanism can include a latch member that is capable of locking the running deck upright when the running deck is in a storage position. To accommodate the transition of the running deck going from an operating position (where the running deck is laid on the floor and is transverse to the exercise machine's frame) to the storage position, portions of the exercise machine such as arm rests, control modules, and other portions of the treadmill may be moved from their operational positions to storage positions to make room for the running deck. The operational position of arm rests may be transverse to the frame while in its operating position and be aligned with the frame while in its storage position. In another example, the operating position of the control module may be transverse to the arm rests while in its operating position, but aligned with the arm rests while in its storage position.

The control module may be attached to the exercise machine's frame directly or indirectly through another component of the exercise machine. Such a platform may incorporate a display, a first control module, or another feature to assist the user with a workout. The platform may be capable of folding downward to form a desk in front of the user while the user is exercising on the machine. In such a downward folded position, the control module is in a storage position while the arm rests are in an operating position.

A latch member of the locking mechanism may be used to support the exercise platform (i.e. running deck for treadmill exercise machines) in the storage position. Prior to moving the exercise platform into an upright position, the arm rests may be rotated away from the latch member into the storage position. As the exercise platform is moved into the place, the latch member may hook onto a lip, a protrusion, or another type of feature of the exercise platform and prevent the exercise platform from falling out of the storage position.

Additionally, the single latch member may be shaped to interlock directly with a support member on which the arm rests are formed. The single latch member may include a first protrusion and a second protrusion that generally protrude in the same direction. The first protrusion is positioned to interlock with the running deck, and the second protrusion is positioned to interlock with the support member on which the arm rests are formed. The single latch member may be capable of interlocking with both the running deck and the arm rest support member at the same time. The latch member may also include a third protrusion that is shaped and positioned to interlock with the arm rest support member when the arm rests are in the operating arm rest position.

For purposes of this disclosure, the term "aligned" means parallel, substantially parallel, or forming an angle of less than 35 degrees. For purposes of this disclosure, the term "transverse" means perpendicular, substantially perpendicular, or forming an angle between 55 and 125 degrees.

Figure 2:
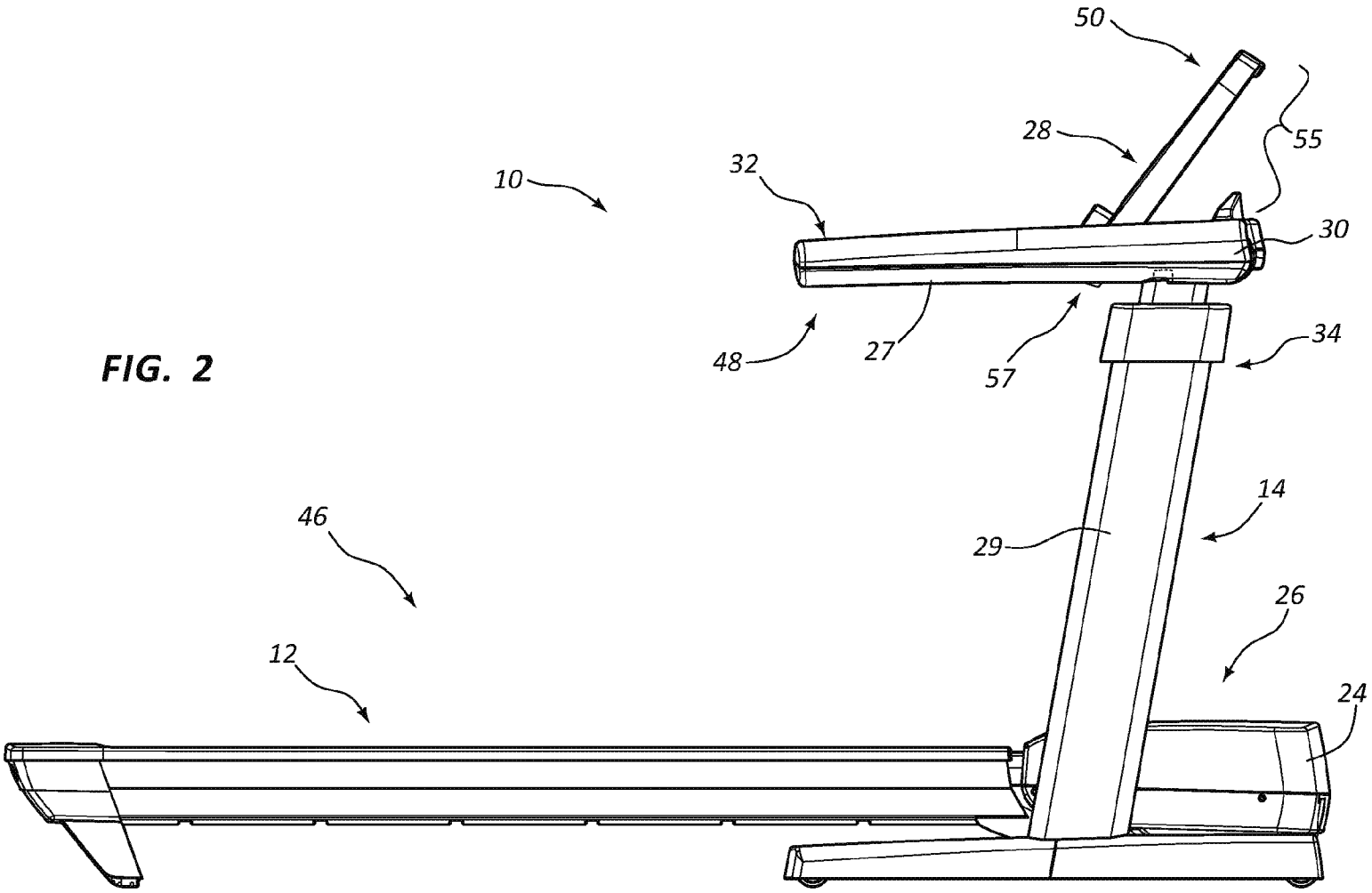
FIG. 2 illustrates a side view of the exercise machine of FIG. 1.
Figure 3:
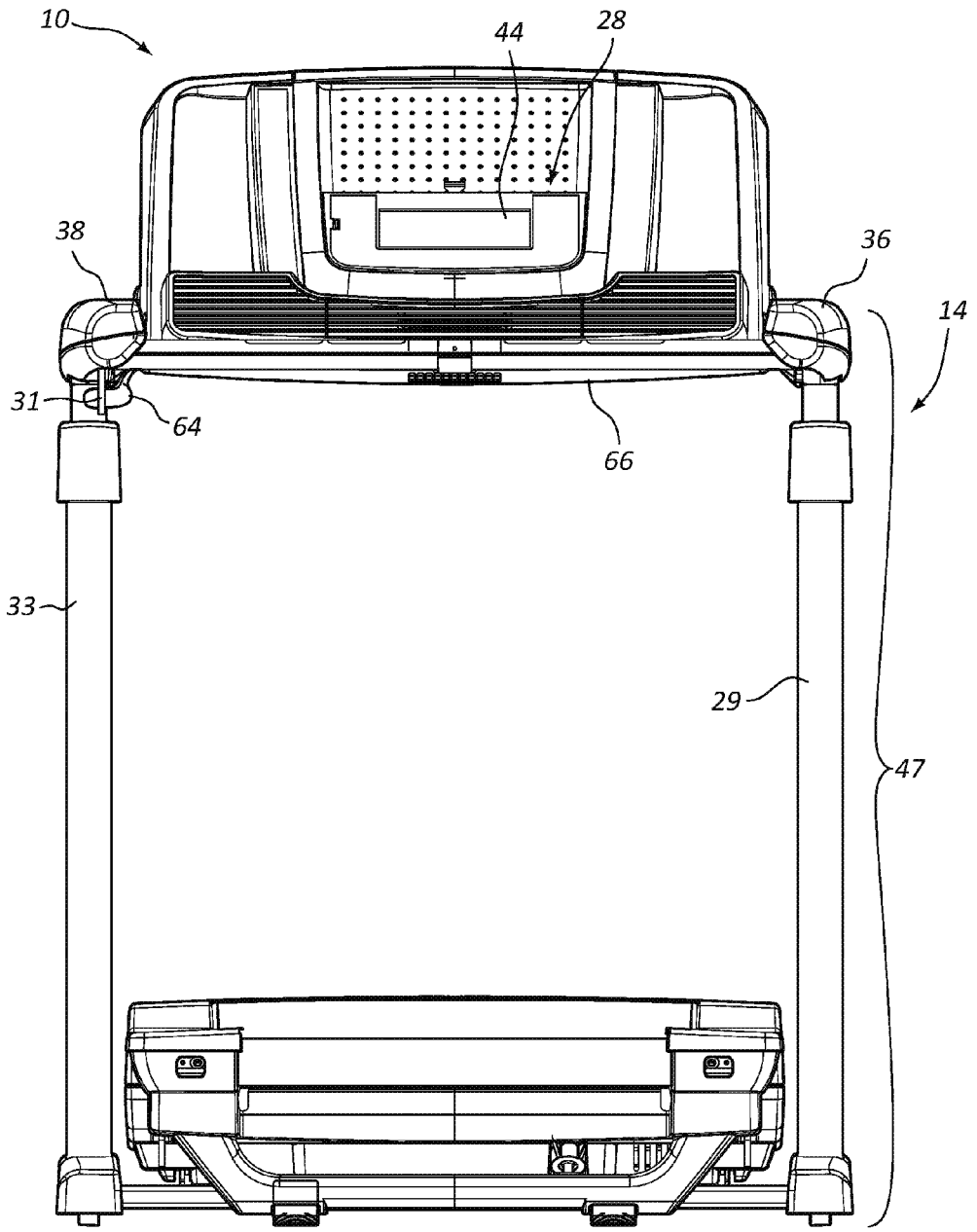
FIG. 3 illustrates a back view of the exercise machine of FIG. 1.

Particularly, with reference to the figures, FIGS. 1-3 depict a treadmill 10. The treadmill 10 includes an exercising mechanism, such as a running deck 12 that can support the weight of a user and that is attached to a frame 14. The running deck 12 incorporates a conveyor belt 16 that extends from a first pulley 18 to a second pulley (not shown) at location 20. The underside of the conveyor belt's midsection is supported by a low friction surface that allows the conveyor belt's underside to move without creating significant drag. The conveyor belt 16 is moved by a motor (not shown) that is connected to the first pulley 18 and is disposed within a housing 24 formed in a front portion 26 of the running deck 12. As the conveyor belt 16 moves, a user positioned on the conveyor belt 16 can walk or run in place by keeping up with the conveyor belt's speed.

A control module 28 is also supported by the frame 14. The control module 28 is connected to the frame 14 through a support member 30, which is attached to a first post 29 of the frame 14 and a second post 33 of the frame 14. In the example of FIGS. 1-3, the support member 30 positions arm rests 32 near the control module 28 such that a user can support himself or herself during exercise. The arm rests 32 may comprise a U-shaped body 37 of the support member 30 positioned to form a first hand grip 39 on a first end 41 of the U-shaped body 37 and a second hand grip 43 on a second end 45 of the U-shaped body 37. The support member 30 is attached to a first portion 34 of the frame 14. The control module 28 is supported by the arms 36, 38 of the support member 30 on which the arm rests 32 are formed. Further, a grip bar 40 extends from the first support arm 36 to the second arm 38. While this example has been describe with specific reference to a specific type of arm rest, any appropriate type of arm rest may be used. For example, the arm rests may be hand holds, guides, rods, or other structures on which a user may at least partially support himself or herself.

The control module 28 allows the user to perform a predetermined task while simultaneously operating an exercise mechanism of the treadmill 10 such as operating the running deck 12. Such predetermined tasks may be tasks that can be executed by the control module 28. The control module 28 may include controls to adjust the speed of the conveyor belt 16, adjust a volume of a speaker integrated into the treadmill 10, adjust a tilt angle of the running deck 12, select an exercise setting, control a timer, change a view on the control module's display 44, monitor the user's health parameters, perform other tasks, or combinations thereof. Buttons, levers, touch screens, or other mechanisms may be incorporated into the control panel and may be used by the user to control at least some of the functions mentioned above.

The control module 28, which incorporates the display 44, may include multiple buttons that can be used to control the functions mentioned above. Information relating to these functions may be presented to the user through the display 44. For example, a calorie count, a timer, a distance, a selected program, another type of information, or combinations thereof may be presented to the user through the display 44.

In the examples of FIGS. 1-3, the running deck 12 is in a platform operating position 46 where the running deck is positioned to be transverse a length 47 of the frame 14. Also, the arm rests 32 are in an arm rest operating position 48 where the arm rests 32 are positioned in a convenient arm's reach for a user who is standing on the running deck 12. Such convenient locations may include aligning the first support arm 36 and a second support arm 38 of the support member 30 in a direction that is aligned with the length 49 of the running deck 12 when the running deck is in a platform operating position 46, when aligned in a direction that is transverse the length 47 of the frame 14, when the arm rests are in another position, or combinations thereof. Further, in the examples of FIGS. 1-3, the control module 28 is in a module operating position 50. In such a position, the control module 28 may be orientated and/or positioned in any appropriate orientation and/or position that provides a user convenient access to the control of the control module 28 while the user is standing on the running deck 12. For example, in such a module operating position 50, the control module 28 may be oriented such that its height 55 is transverse to a direction of the length 51 of the support arms 36, 38. Further, the height 55 of the control module 28 may be aligned with the length 47 of the frame 14.

The locking mechanism 54 is integrated into the second post 33. A latch member 64 of the locking mechanism 54 protrudes into the space between the first post 29 and the second post 33. In this example, a locking ring 31 is attached to an underside 27 of the second support arm 38 and interlocks with the latch member 64. Thus, the latch member 64 locks the arm rests 32 into the arm rest operating position 48.

Figure 4:
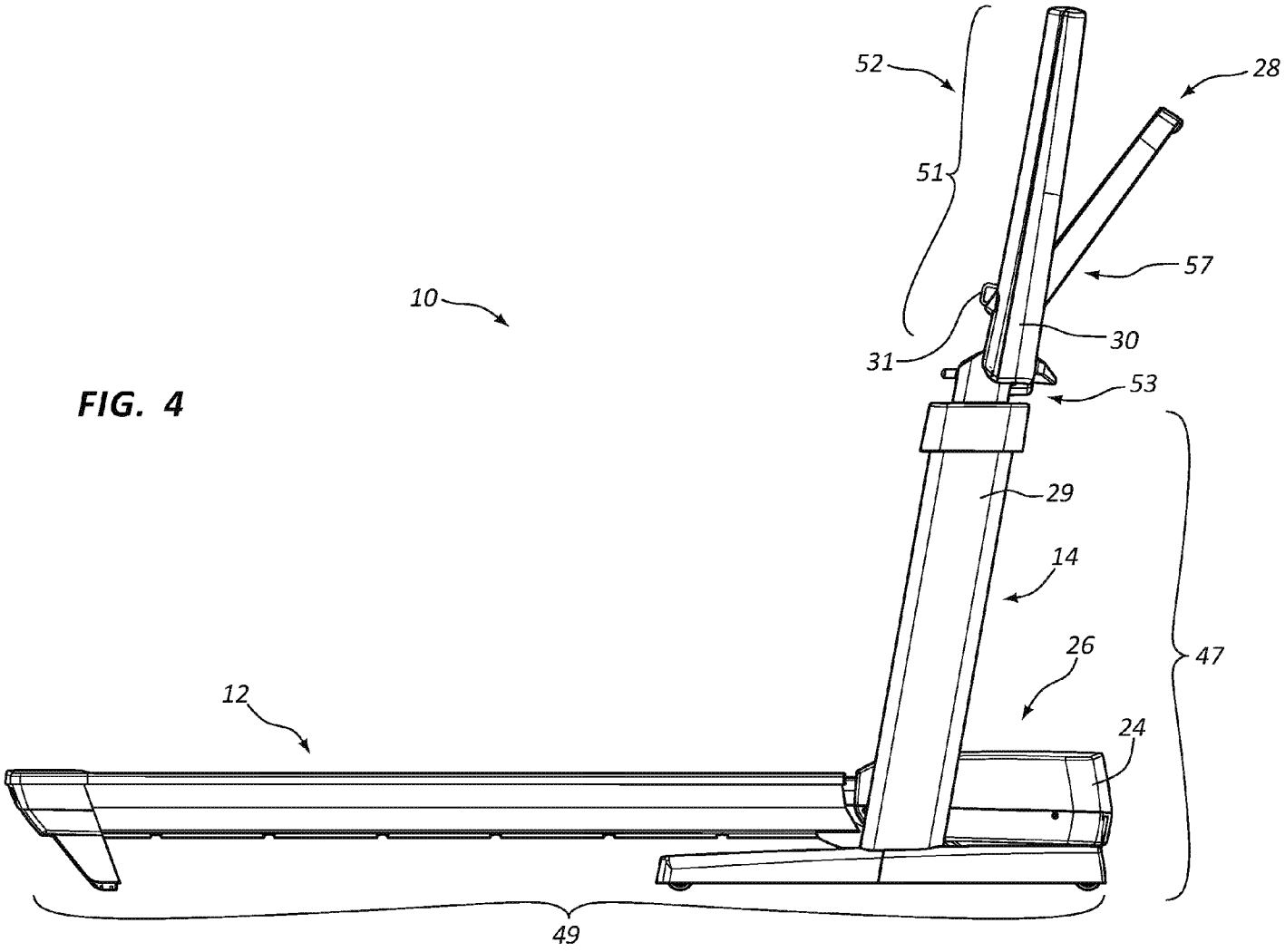
FIG. 4 illustrates a side view of an example of an exercise machine with arm rests in an storage position in accordance with the present disclosure.

FIG. 4 illustrates a side perspective view of an example of an exercise machine with arm rests in an arm rest storage position 52 in accordance with the present disclosure. The arm rests 32 are part of the support arms 36, 38 and/or the support member 30. The support member 30 is pivotally attached to the first portion 34 of the frame 14. In this example, the folding mechanism is an arm rest pivot joint 53 that is connected to the first post 29 and the second post 33 of the frame 14. The folding mechanism may include a pivot bar, a hinge, or another mechanism that allows the support member 30 to be rotated. The support member 30 may rotate about an axis of rotation that is aligned with a direction from the first post 29 of the frame 14 to the second post 33 of the frame 14. In other examples, the support member 30 rotates about multiple pivot and/or hinges. For example, each of the first and second support arms 36, 38 may include separate pivot connections. In such examples as described above, the axis of rotation for moving the arm rests 32 from the arm rest operating position 48 to the arm rest storage position 52 is aligned with a direction from the first post 29 of the frame 14 to the second post 33 of the frame 14. In alternative examples, the axis of rotation for moving the arm rests 32 from the arm rest operating position 48 to the arm rest storage position 52 is transverse the direction from the first post 29 to the second post 33. In such an example, the axis of rotation may be aligned with the length 49 of the running deck 12.

The arm rest storage position 52 may be in any appropriate orientation that is aligned with the length 47 of the frame 14. For example, the support member 30 may rotate away from the locking mechanism 54 until the support member's rotation is prevented. Preferably, the stopping mechanism, such as another protruding object or another type of stopping mechanism, locates the support member 30 such that the arm rests 32 are positioned in the arm rest storage position 52. In some examples, the alignment of the arm rests 32 in the arm rest storage position 52 is such that the length 51 of the support arms 36, 38 and the length 47 of the frame 14 are substantially parallel. In other examples, the length 51 of the support arms 36, 38 and the length 47 of the frame 14 form an angle less than 25 degrees.

While this example has been described with specific reference to the arm rests being formed in the arms 36, 38 of a support member 30, any appropriate type of arm rests 32 may be used in accordance with the present disclosure. For example, the arm rests 32 may be part of one or multiple hand rails that are attached to the frame 14 and/or other components of the treadmill 10 at the ends of the hand rails. In the example of FIG. 4, the support arms protrude in a direction that aligns with the length 49 of the running deck 12. However, in other examples, the arm rests 32 may protrude in directions that are transverse to the length 49 of the running deck 12.

Figure 5:
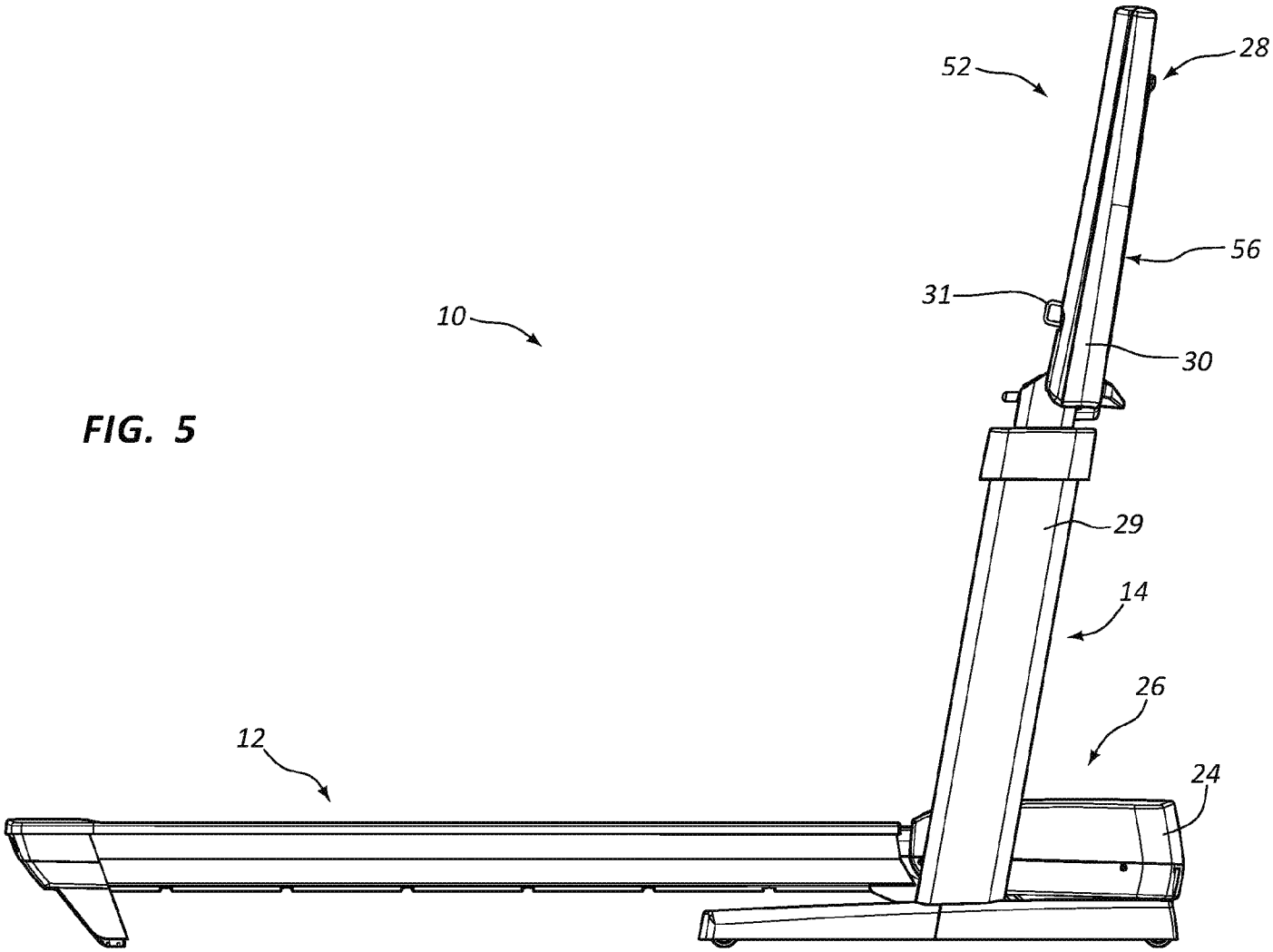
FIG. 5 illustrates a side view of an example of an exercise machine with arm rests and a control module in storage positions in accordance with the present disclosure.

FIG. 5 illustrates a side perspective view of an example of an exercise machine with arm rests 32 and a control module 28 in storage positions in accordance with the present disclosure. In this example, control module 28 is folded into the support member 30 into a module storage position 56 such that the control module 28 is aligned with the support member 30 and/or arm rests.

The folding mechanism includes a module pivot joint 57 that is connected to the U-shaped body 37 of the support member 30. However, any appropriate folding mechanism may be used to rotate the control module 28 to align with the arm rests 32 and/or the support member 30. In this example, the folding mechanism includes an axis of rotation that is aligned with a direction from the first post 29 to the second post 33 of the frame about which the control module 28 can rotate.

While this example is depicted in FIG. 5 with specific reference to the control module 28 being rotated in a first direction to fold into the support member 30, the control module 28 may be rotated in any appropriate manner to put the control module 28 in a position appropriate for storage. For example, the control module 28 may be rotated in a direction away from the support arms 36, 38 until a height 55 of the control module 28 is aligned with a length 51 of the support arms 36, 38.

The module storage position 56 may be any appropriate position where the height 55 of the control module 28 is aligned with the arm rests 32. Thus, if the arm rests 32 are in the arm rest operating position 48, the height 55 of the control module 28 can be transverse the length 47 of the frame 14. Alternatively, if the arm rests 32 are in the arm rest storage position 52, the height 55 of the control module 28 can be aligned with the length 47 of the frame 14 while in the arm rest storage position 52.

Figure 6:
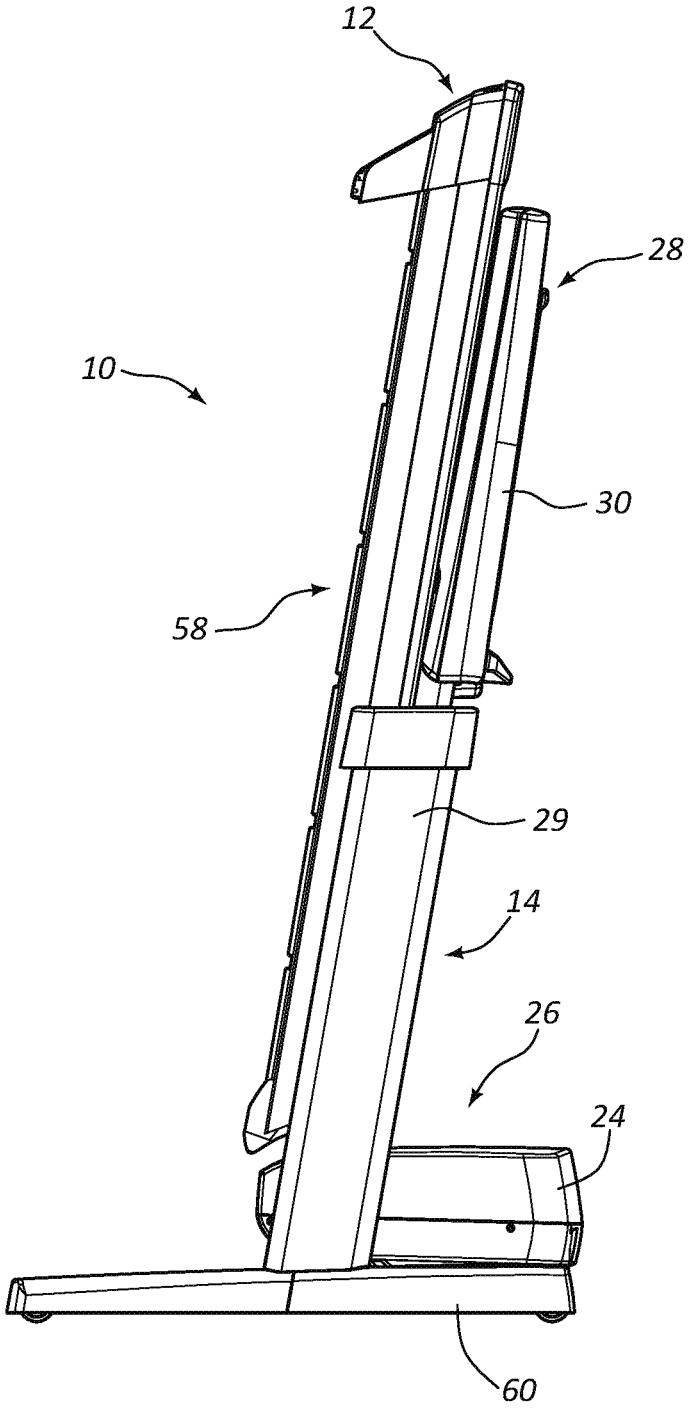
FIG. 6 illustrates a side view of an example of an exercise machine with arm rests, a control module, and an exercise platform in storage positions in accordance with the present disclosure.

FIG. 6 illustrates a side perspective view of an example of a treadmill 10 with arm rests 32, a control module 28, and a running deck 12 in storage positions in accordance with the present disclosure. In this example, the running deck 12 has moved from a platform operating position 46 to a platform storage position 58. The running deck 12 has been rotated upright about an axis of rotation located in the front portion 26 of the running deck 12. This axis of rotation is generally aligned with a direction that goes from a first post 29 of the frame 14 to a second post 33 of the frame 14. In the platform storage position 58, the length 49 of the running deck 12 is generally aligned with the length 47 of the frame 14. In some examples, the alignment of the lengths of the frame 14 and the running deck is such that the length 49 of the running deck 12 is generally parallel with the length 47 of the frame 14. In other examples, the alignment of the lengths of the frame 14 and the running deck is such that the length 49 of the running deck 12 forms an angle that is less than 25 degrees with the length 47 of the frame 14.

Any appropriate mechanism may be used to allow the running deck 12 to rotate upward. For example, the running deck 12 may be pivotally connected to the frame 14. In other examples, the running deck 12 may include a folding joint where at least a portion of the front portion 26 that is connected to the frame 14 remains stationary with the frame 14 while the far portion of the running deck 12 is moved about the folding joint into the platform storage position 58.

The frame 14 may include a pair of legs 60 that can support the center of gravity of the treadmill 10 when the running deck 12, the arm rests 32, and the control module 28 are in their respective storage positions. The legs 60 may be equipped with rollers or other features that allow the treadmill 10 to be moved while the components of the treadmill are in their respective storage positions.

The running deck 12 may be held in the platform storage position 58 with a locking mechanism 54. The locking mechanism 54 may include a latch member that hooks into a lip or other feature formed in the running deck 12. Such a latch member may be securely affixed to the frame 14 such that the weight of the running deck 12 in its platform storage position 58 is loaded to the frame 14.

In some examples, at least one of the running deck 12, the arm rests 32, or the control module 28 can transition between their respective operating positions and storage positions manually. In other examples, at least one of the running deck 12, the arm rests 32, or the control module 28 can transition between their respective operating positions and storage positions with an actuator, an electrically driven component, a hydraulic driven component, a pneumatic driven component, another type of component, or combinations thereof. For example, the control module 28 may provide a button, a touch screen, or another type of input mechanism that provides the user an option to transition one or more of the running deck 12, the control module 28, and the arm rests into either their storage positions or their operating positions. Likewise, such an input mechanism may be located elsewhere on the treadmill 10. Such input mechanisms may cause each of the running deck 12, the arm rests 32, and the control module 28 to each move into their operating positions together in response to a single user command or into their operating positions in response to a user single command. In some examples, at least one of these components responses to an individual command to move into either the storage or operating positions.

Figure 7:
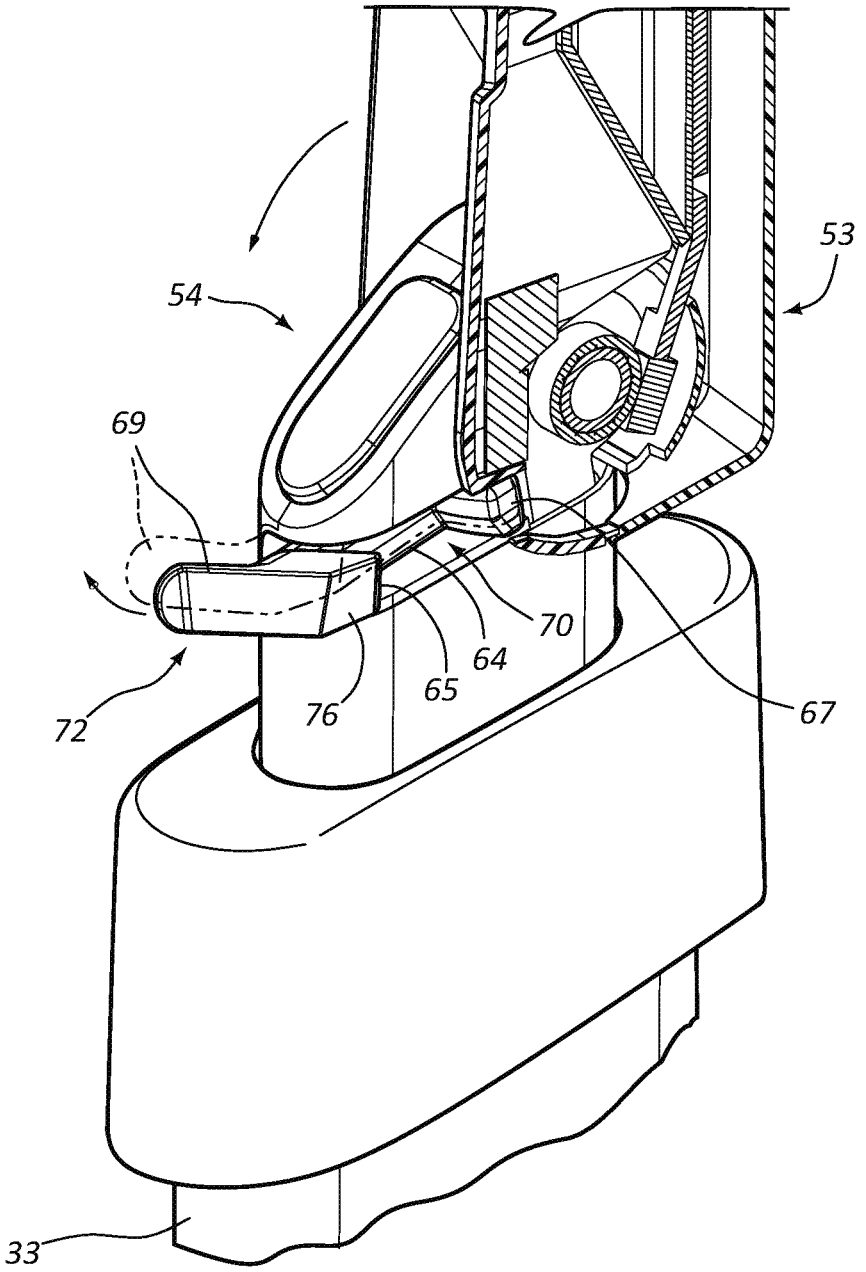
FIG. 7 illustrates a perspective view of a locking mechanism in accordance with the present disclosure.

FIG. 7 illustrates a perspective view of a locking mechanism 54 in accordance with the present disclosure. In this example, the locking mechanism 54 includes a latch member 64 that is integrated into either the first post 29 of the frame 14 or a second post 33 of the frame. A portion of the support member 30 is depicted in the example of FIG. 7 in an upright position that places the arm rests 32 in their arm rest storage position 52.

The latch member 64 may have any appropriate shape sufficient to connect the running deck 12 to the frame 14. In the example of FIG. 7, the latch member 64 includes a pivot end (not shown) pivotally secured within a frame cavity 70 formed in the frame 14. The pivot end is oriented such that the latch member 64 can pivot into or out of the space between the first and second posts 29, 33 by rotating about an axis of rotation that is parallel, aligned, or substantially aligned with the posts 29, 33 of the frame 14. The latch member 64 also includes a free end 72 that is shaped to hook or otherwise attach to the running deck 12 when in the platform storage position 58.

An inner edge of the latch member 64 is pivotable into the frame cavity 70 as the running deck 12 contacts and pushes an outer edge 76 of the latch member 64 inward in response to the running deck 12 moving into the platform storage position 58. The outer edge 76 is shaped to accommodate frequent sliding contact with the running deck 12. The outer edge 76 may be slightly rounded, angled, or otherwise shaped to accommodate the sliding contact.

In some examples, as a lip, a protrusion, or another feature of the running deck 12 moves past the free end 72 of the latch member 64, the lip or other feature is followed by a void sufficiently large enough to allow a first protrusion 65 of the latch member 64 to return to its protruding position. After the latch member 64 returns to its protruding position, the free end 72 is on the back side of the lip or other feature of the running deck 12 and holds the running deck 12 in place via an interference.

In a situation where the running deck 12 is pulled by gravity or otherwise back towards its platform operating position 46, such movement is stopped by the protruding latch member 64. To free the running deck 12 from the latch member 64 so that the running deck 12 can return to the platform operating position 46, a user may push the latch member 64 back into the frame cavity 70 to allow the lip or other feature to pass by the latch member 64.

The platform storage position 58 of the running deck 12 can prevents the support member 30 from moving back such that the arm rests 32 return to their arm rest operating position 48. Thus, the running deck 12, while in the platform storage position 58, keeps the arm rests 32 in their arm rest storage position 52. However, in some embodiments, the latch member 64 includes a second protrusion 67 that is shaped to interlock with the support member 30 when the support member 30 is upright and causes the arm rests 32 to be in the arm rest storage position 52. Thus, the latch member 64 can lock the arm rests 32 in the arm rest storage position 52 independently without the running deck 12 being in the platform storage position 58.

Thus, the single latch member 64 retains both the running deck 12 and the arm rests 32 in their storage positions. In some examples, the mere positioning of the running deck 12, the support member 30, the arm rests 32, or other components of the treadmill 10 in their storage positions blocks the control module 28 from returning to its module operating position 50. In such an embodiment, a single latch member of a locking mechanism 54 retains each of the running deck 12, control module 28, arm rests 32, and/or other components in their respective storage positions.

Figure 8:
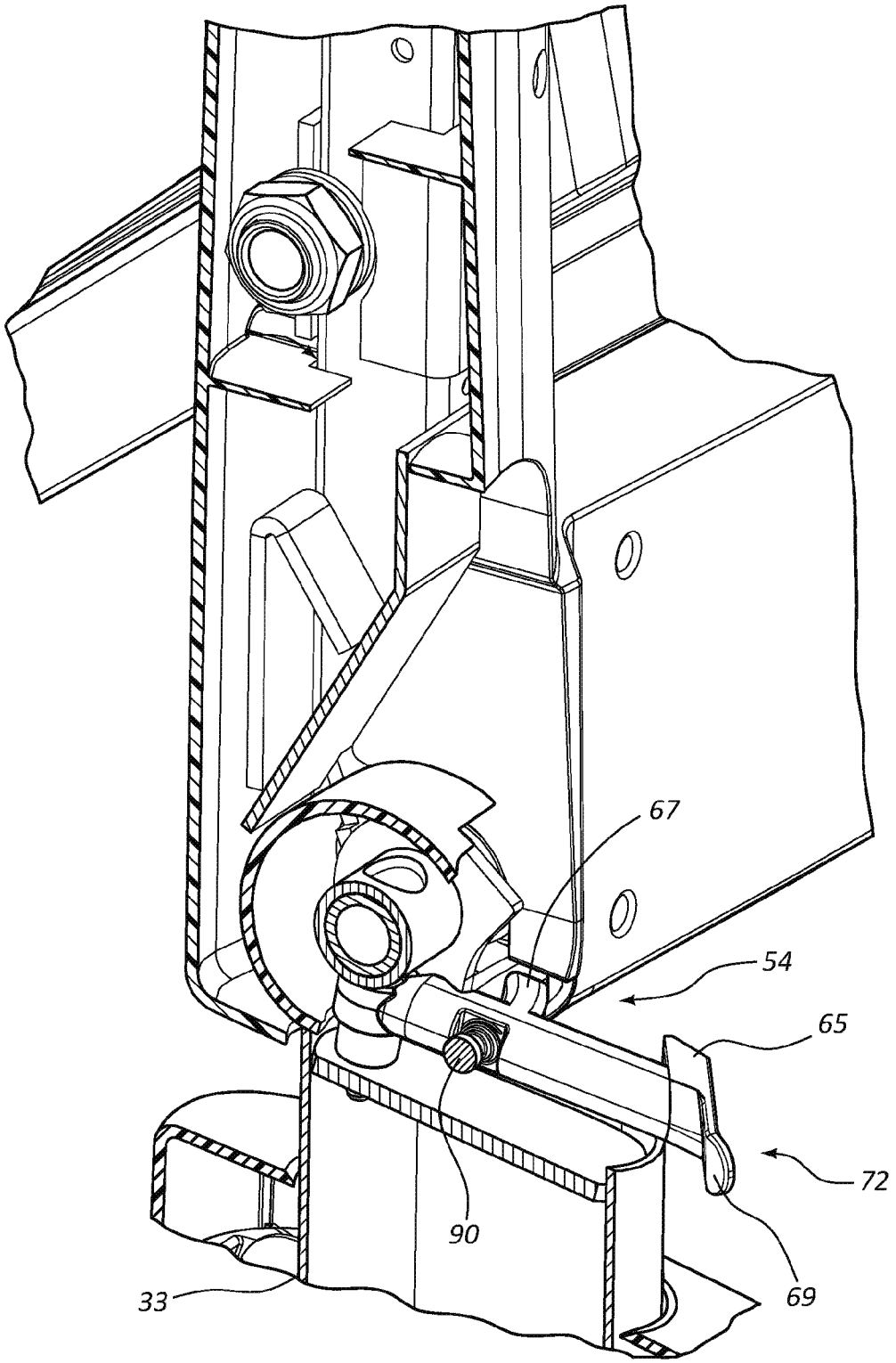
FIG. 8 illustrates a perspective view of a locking mechanism in accordance with the present disclosure.

FIG. 8 illustrates a perspective view of a locking mechanism 54 in accordance with the present disclosure. The latch member 64 includes a pivot end 68 secured to a frame cavity. The free end 72 of the latch member 64 includes a first protrusion 65 shaped to attach to the running deck 12 and a third protrusion 69 that is shaped to interlock with the locking ring 31 attached to the underside 27 of the support member 30 when the arm rests 32 are in the arm rest operating position 48. A spring 90 is positioned within the frame cavity 70 to urge the free end 72 into a protruding position. The outer edge 76 of the free end 72 is angled or otherwise shaped to minimize impact damage or appropriately move as the running deck 12 engages the free end 72.

Figure 9:
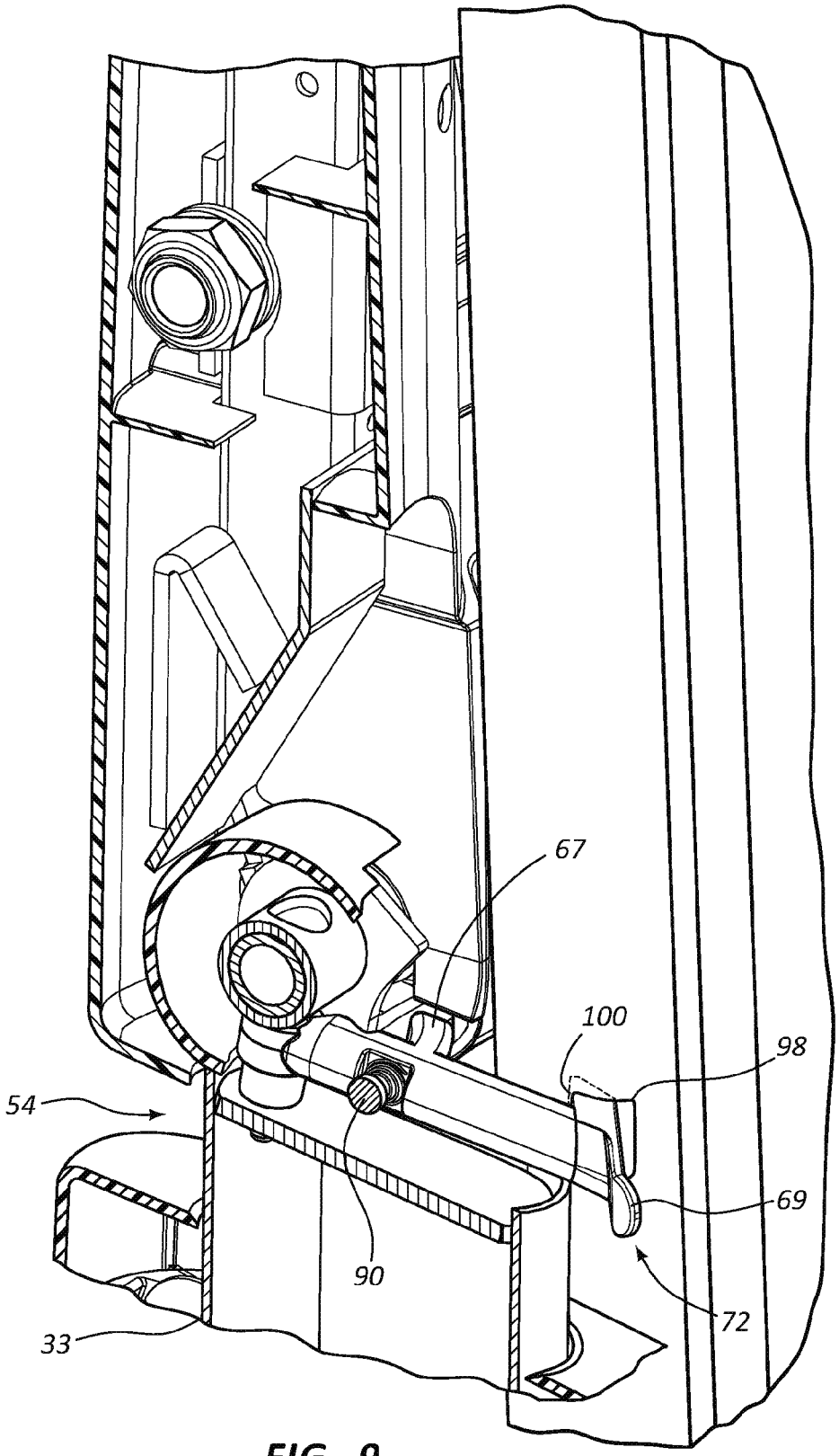
FIG. 9 illustrates a perspective view of a locking mechanism supporting an exercise platform in accordance with the present disclosure.

FIG. 9 illustrates a perspective view of a locking mechanism 54 supporting a running deck 12 in accordance with the present disclosure. In this example, the running deck 12 is upright and in the platform storage position 58. The latch member 64 is in a protruding position and locked with the running deck 12.

The latch member 64 is inserted into a platform cavity 98 that includes a lip 100. The latch member 64 makes contact with the running deck 12 at the lip, where the weight of the running deck 12 is loaded to the frame 14. The platform cavity 98 may be formed in any appropriate location of the running deck 12. For example, the platform cavity 98 may be formed in a top surface or side of the running deck 12 when the running deck 12 is in the platform operating position 46. The locations of the latch member 64 and the platform cavity 98 are matched such that as the running deck is brought into the platform storage position 58, the latch member 64 and the platform cavity 98 interlock.

In alternative examples, the lip 100 of the running deck 12 or other type of exercise platform do not include a cavity. In such examples, the lip 100 may be formed in a side of the running deck, be integrated into a groove or recess of the running deck 12, be formed in a back side of the running deck 12, be in another location, or combinations thereof. In some examples, the lip is formed in a protrusion of the running deck 12. For example, the lip may be incorporated in a latch hole formed in such a protrusion.

While the examples of FIG. 7-9 depict the locking mechanism 54 as having a latch member 64 with a specific shape and attachment to the frame 14, any appropriate type of locking mechanism 54 may be used in accordance with the principles described in the present disclosure. For example, the locking mechanism 54 may include a slideable rod that can slide into or out of a position that protrudes between the first and second posts 29, 33 of the frame 14. When in the protruding position, such a rod may obstruct movement of the running deck 12. Such a rod may be moved into a retracted position to allow the running deck 12 to be moved into the platform storage position 58. To secure the running deck 12 into the platform storage position 58, the rod can be moved into the protruding position such that the rod interlocks, penetrates, enters, or otherwise attaches to the running deck 12 and holds the running deck 12 in place. Such a slideable rod may be at least partially secured within a cavity of the frame, or such a rod may be secured to the outside of the frame.

In another alternative embodiment, the locking mechanism 54 may include a locking ring 31 that hooks to the running deck 12 or otherwise locks the running deck 12 in place where the member rotates into the space between the posts 29, 33 by pivoting about an axis of rotation that is transverse to the length 47 of the frame 14.

In yet other alternative examples, multiple latch members may be incorporated into a single post of the frame 14. In such an example, the weight of the running deck 12 may be distributed across multiple latch members. A single release mechanism may be used to cause the multiple latch members to move into retracted positions with a single command and at the same time to provide a convenient mechanism for releasing the running deck 12 from each of the latch members at the same time. In yet other alternative examples, the locking mechanism 54 may be incorporated into both the first and second posts 29, 33 of the frame 14. Additionally, at least one locking mechanism 54 may be incorporated into the cross bar 66 (see FIG. 3) of the frame 14.

Figure 10:
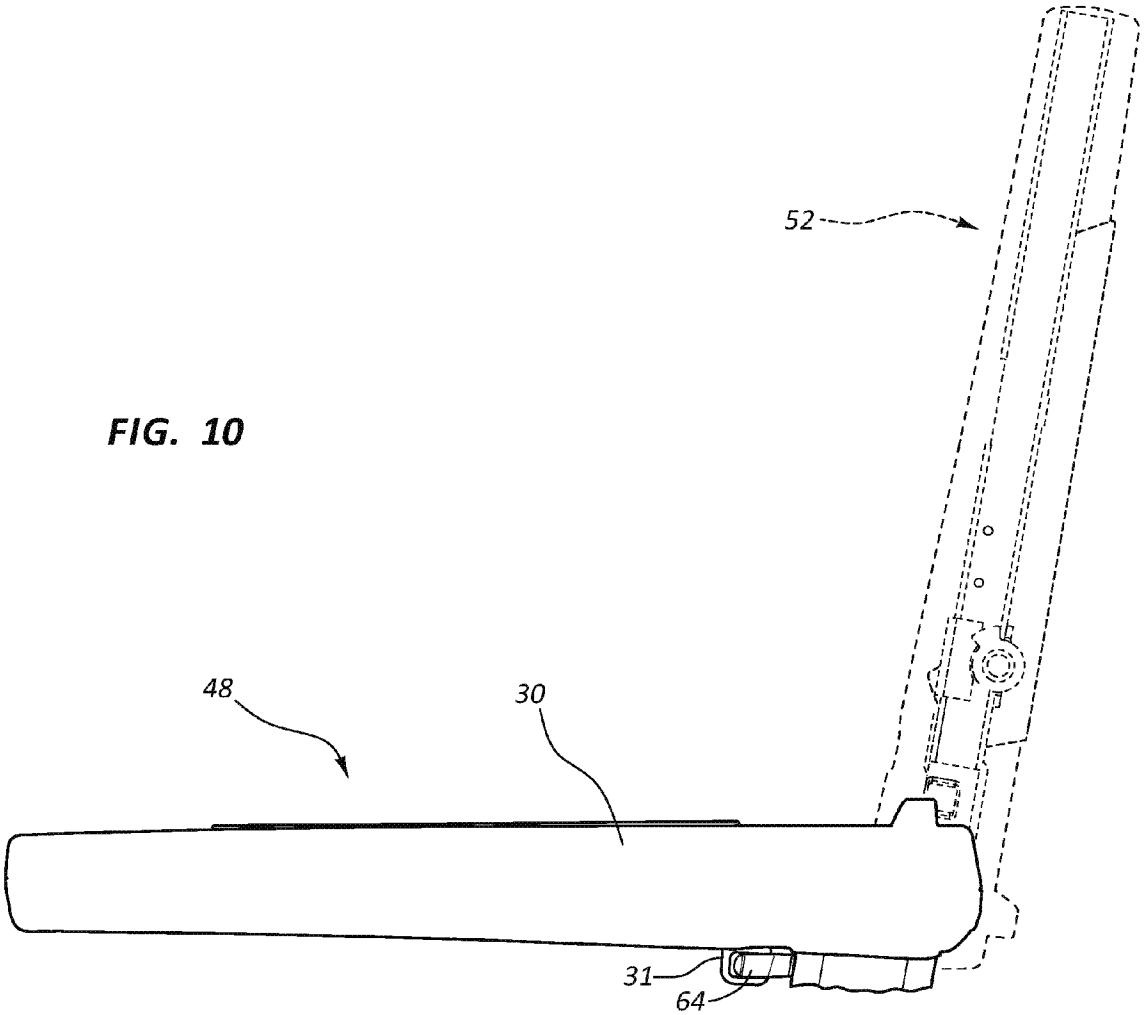
FIG. 10 illustrates a side view of arm rests in an arm rest operating position in accordance with the present disclosure.

FIG. 10 illustrates a side view of arm rests 32 in an arm rest operating position 48 in accordance with the present disclosure. In this example, the support member 30 is positioned such that the arm rests 32 are in the arm rest operating position 48. The locking ring 31 is attached to the underside 27 of the support member 30 and is interlocked with the third protrusion 69 of the latch member 64.

While the embodiments have been described above with specific reference to treadmills, the principles described in the present disclosure may be incorporated into any appropriate exercise machine. For example, the principles described herein may be incorporated into elliptical machines, rowing machines, stepper machines, stationary bikes, other types of exercise machines, or combinations thereof.

INDUSTRIAL APPLICABILITY

In general, the invention disclosed herein may provide a user the advantage of storing a stationary exercise machine in a compact manner. A further advantage is that the exercise machine can be folded into a storage position with a minimal number of parts. For example, a single latch member can be used to hold multiple components of the exercise machine in storage positions.

One of the components that can be supported by the latch member in its storage position includes an exercise platform that can be folded into the machine's frame. Such exercise machines and exercise platforms may include a treadmill running deck, pedals of a stationary bike or elliptical machine, or another exercise mechanism of a different type of exercise machine.

Further, the locking mechanism as described above provides may prevent the running deck or another type of exercise platform from damaging walls and inanimate objects. Such an advantage instills confidence in users that they may put their exercise machines in the compact, storage positions. Further, the single latch member described above is reliable, easily manufactured, and strong enough to hold the all of the components of the entire exercise machine in their storage positions.

Pivot joints between the control module and the support member, between the frame and the running deck, and between the support member and the frame allow the components of the exercise machine to be easily moved from one position to another. This benefits elderly users as well as those users that have less agility due to recent workouts.

The spring loaded arrangement of the latch member and its associated slideable, outer surface allows the user to fold up the exercise platform without first moving the latch member into a retracted position and then repositioning the latch member into a protruding position. Such movement is done automatically through the spring loaded mechanism.

What is claimed is:

1. An exercise machine, comprising:

a frame;

at least one arm rest connected to a first portion of the frame;

an exercise platform connected to a second portion of the frame;

the at least one arm rest pivotally connected to the first portion to allow the at least one arm rest to be oriented between an arm rest storage position and an arm rest operating position;

the exercise platform pivotally connected to the second portion to allow the exercise platform to be oriented between a platform storage position and a platform operating position; and a locking mechanism to connect the exercise platform to the frame in the platform storage position;

wherein the locking mechanism comprises a single latch member;

wherein the single latch member is shaped to lock the at least one arm rest into an operating arm rest position.

2. The exercise machine of claim 1, further comprising a control module connected to the first portion of the frame, wherein the control module has a pivot connection that allows the control module to move between an operating position and a storage position.

3. The exercise machine of claim 2, wherein the control module is oriented to rotate towards the at least one arm rest into a module storage position.

4. The exercise machine of claim 1, wherein the single latch member protrudes into a space between a first post of the frame and a second post of the frame.

5. The exercise machine of claim 1, wherein the single latch member comprises a slideable surface that is shaped to accommodate moving contact with the exercise platform.

6. The exercise machine of claim 1, wherein the single latch member is shaped to interlock with and lock the at least one arm rest into the arm rest storage position.

7. The exercise machine of claim 1, wherein the locking mechanism is positioned to hook a lip formed in a side of the exercise platform when the exercise platform is in a platform operating position.

8. The exercise machine of claim 1, wherein the at least one arm rest comprises a U-shaped body positioned to form a first hand grip on a first end of the U-shaped body and a second hand grip on a second end of the U-shaped body.

9. The exercise machine of claim 8, wherein a module pivot joint is connected to the U-shaped body.

10. The exercise machine of claim 9, wherein a control module is oriented to fold into the U-shaped body about the module pivot joint.

11. The exercise machine of claim 1, wherein the locking mechanism is spring loaded.

12. An exercise machine, comprising:

a frame;

at least one arm rest and a control module connected to a first portion of the frame;

an exercise platform connected to a second portion of the frame;

the at least one arm rest comprising arm rest pivot joints that allow the at least one arm rest to be oriented between an arm rest storage position and an arm rest operating positions;

the control module comprising module pivot joints that allow the control module to be oriented between a module storage position and a module operating position;

the exercise platform comprising platform pivot joints that allow the exercise platform to be oriented between platform a storage position and a platform operating position;

a latch member configured to hold the at least one arm rest and the exercise platform in the storage positions by locking the first portion of the frame to the exercise platform;

the latch member is shaped to interlock with and to lock the at least one arm rest into the arm rest storage position; and the latch member is shaped to lock the at least one arm rest into an operating hand hold position.

13. The exercise machine of claim 12, wherein the latch member comprises a slideable surface that is shaped to accommodate moving contact with the exercise platform.

14. The exercise machine of claim 12, wherein the latch member protrudes into a space between a first post of the frame and a second post of the frame.

15. The exercise machine of claim 12, wherein the latch member is spring loaded.

16. The exercise machine of claim 12, wherein the at least one arm rest comprises a U-shaped body positioned to form a first hand grip on a first end of the U-shaped body and a second hand grip on a second end of the U-shaped body.

17. An exercise machine, comprising:

a frame;

at least one arm rest and a control module connected to a first portion of the frame;

the at least one arm rest comprises a U-shaped body positioned to form a hand grip on a first end of the U-shaped body and a second end of the U-shaped body;

an exercise platform connected to a second portion of the frame;

the at least one arm rest comprising arm rest pivot joints that allow the at least one arm rest to be oriented between an arm rest storage position and an arm rest operating positions;

the control module comprising module pivot joints that allow the control module to be oriented between a module storage position and a module operating position;

the exercise platform comprising platform pivot joints that allow the exercise platform to be oriented between platform a storage position and a platform operating position;

a single spring loaded latch member latchable to hold the at least one arm rest and the exercise platform in the storage positions by locking the first portion of the frame to the exercise platform;

wherein the single spring loaded latch member protrudes into a space between a first post of the frame and a second post of the frame;

wherein the single spring loaded latch member is shaped to interlock with and to lock the at least one arm rest into the arm rest storage position; and the single spring loaded latch member is shaped to lock the at least one arm rest into an operating hand hold position.

18. The exercise machine of claim 17, wherein the single spring loaded latch member comprises a slideable surface that is shaped to accommodate moving contact with the exercise platform.

* * * * *